United States Patent [19]

Eubanks et al.

[11] Patent Number: 4,854,625

[45] Date of Patent: Aug. 8, 1989

[54] MULTI-PURPOSE TOOL HOLDER FOR EXTENSION HANDLE

[76] Inventors: Furney Eubanks; Randy Eubanks, both of Rte. 2, Box 361, Trenton, N.C. 28585

[21] Appl. No.: 192,550

[22] Filed: May 11, 1988

[51] Int. Cl.[4] ..... A47F 13/06

[52] U.S. Cl. ..... 294/19.1; 15/144 R; 15/146

[58] Field of Search ..... 294/19.1; 15/143 R, 15/144 R, 144 A, 146, 159 R, 236.03

[56] References Cited

U.S. PATENT DOCUMENTS 3,357,035 12/1967 Ficke ..... 15/144 R 3,866,257 2/1975 Cansdale, Sr. ..... 15/144 R 4,127,296 11/1978 Thomson ..... 294/19.1

*Primary Examiner*—James B. Marbert

*Attorney, Agent, or Firm*—Fred K. Carr

[57] ABSTRACT

The present invention relates to a multi-purpose tool holder for holding various tools on an extension handle. The holder includes a flat support plate on the end of the extension handle. The support plate has a cable arrangement such that two cable loops are formed on top of it. The tool to be held is placed through the cable loops, and a wing nut is tightened on a threaded guide bar to tighten the cable securely around the tool. The tool holder can be used for many purposes such as holding paint scrapers, paint brushes, scrub brushes, weegies, acid brushes, paint roller frames, and other related tools.

5 Claims, 2 Drawing Sheets

MULTI-PURPOSE TOOL HOLDER FOR EXTENSION HANDLE

REFERENCE TO REALTED DOCUMENTS

This application entitled Multi-Purpose Tool Holder For Extension Handles is related to Disclosure Document No. 180305.

FIELD OF THE INVENTION

This invention relates to a multi-purpose tool holder, and in particular, to a tool holder to be used on an extension handle.

BACKGROUND OF THE INVENTION

It is common practice in the building and repair trades to attach tools such as scrapers, paint brushes, and various other tools to the end of an extension handle in order to reach high and other hard to get to places. This practice saves time by not having to use ladders because the extension handle, in effect, gets one closer to the work. Time is saved because the worker does not have to climb up and down the ladder to move it.

Certain tools have a specially designed screw insert for attaching extension handles such as paint rollers. However, not all tools are built with this type extension hand insert. Even the ones that often have special handles with a particular thread arrangement. There is not presently available a common extension handle for use with various tools including tools with no extension handle insert.

Another practice is to tape various tools to extension handles. The problems associated with this are two fold. First, the tape often gives under pressure not securely holding the tool in place. Secondly, it requires time of the worker to tape the tool on and replace when it no longer holds. It can therefore be appreciated that there is a need for a multi-purpose tool holder capable of attaching various tools to an extension handle.

SUMMARY OF THE INVENTION

The present invention relates to a multi-purpose tool holder for holding various tools on an extension handle. The holder is light weight and includes a flat support plate on the end of the extension handle. The support plate has a cable arrangement such that two cable loops are formed on top of it. The tool to be held is placed through the cable loops, and a wing nut is tightened on a threaded guide bar to tighten the cable securely around the tool. This device provides at least two advantages over existing methods: it gives the strength needed to hold the tool securely in place, and the tool can be put on and taken off quickly. The tool holder can be used for many purposes such as holding paint scrapers, paint brushes, scrub brushes, weegies, acid brushes, paint roller frames, and other related tools.

It is a primary object of this invention to provide a tool holder which can be used to hold many different tools.

Another object of this invention is to provide a tool holder which will hold the tool securely, not allowing it to slip during strenuous work.

Another object of this invention is to provide a tool holder in which the tool can be quickly attached and detached.

DETAILED DESCRIPTION OF THE INVENTION

Figure 1:
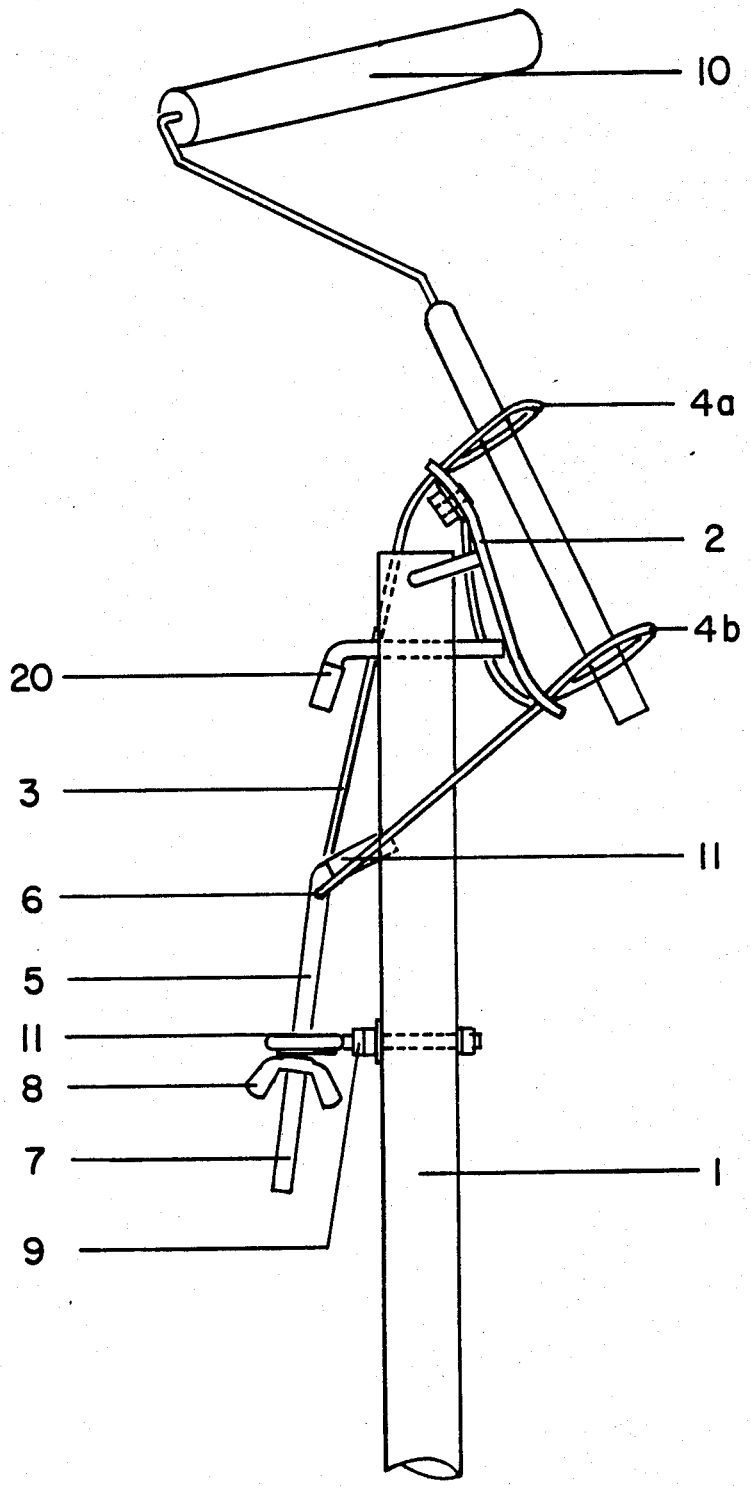
FIG. 1 is a perspective side view of the tool holder showing the extension handle, support plate, and guide bar.

Referring to FIG. 1, there is seen a perspective side view of the tool holder. Extension handle (1) has flat support plate (2) connected at the top. Cable (3) forms upper cable loop (4*a*), passes through hole (6) of guide bar (5), and back to support plate (2) to form lower cable loop (4b). The lower portion of guide bar (5) includes threaded section (7) and wing nut (8). Guide bar (5) is supported by post (9). Post (9) is attached at one end to handle (1) and has hole (11) on other end through which guide bar (5) passes.

Paint roller (10) is used as an example of tool to be held by the tool holder. The handle of roller (10) is placed inside cable loop (4*a*) and cable loop (4*b*). Wing nut (8) on guide bar (5) is then turned clockwise. This causes the cable (3) to tighten securely holding the tool handle against support plate (2). The tool can be removed from the holder by turning wing nut (8) counter clockwise. This loosens the cable (3) allowing one to remove the tool. Guide post (5) has curved extension (11) which keeps guide post (5) and thus cable (3) from twisting.

Figure 2:
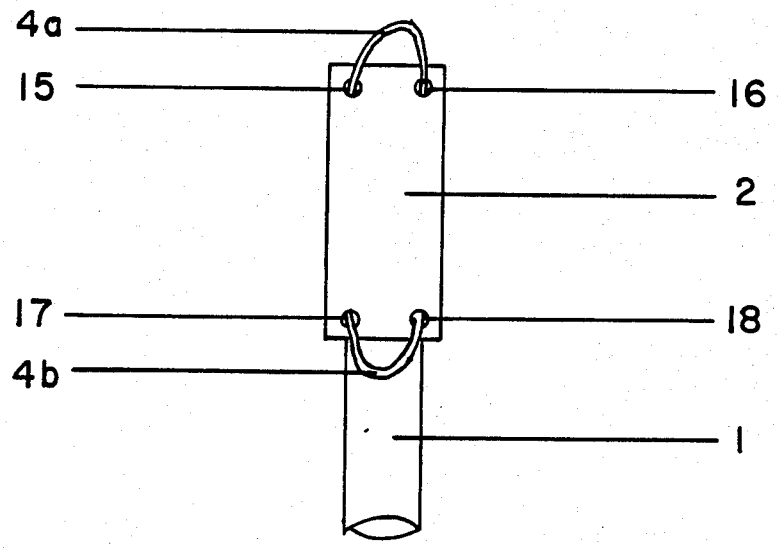
FIG. 2, is a top view of the support plate showing cable arrangement.

Referring now to FIG. 2, there is shown a top view of support plate (2) with cable (3) connections. In a preferred embodiment, plate (2) is a flat plate of metal $\frac{1}{8}$ inch thick, 3.5 inches long, and 1.5 inches wide. Other sizes are possible. Cable (3) is attached to back of plate (2) and passes through hole (15) in upper corner of plate (2). Cable (3) then passes through hole (16) located in other upper corner of plate (2). Cable (3) then passes downward and through hole (6) on guide bar (5) (seen in FIG. 1). Cable (3) then passes upward through hole (17) of plate (2) and over to hole (18) in other lower corner of plate (2). This arrangement forms cable loop (4*a*) and cable loop (4*b*) into which the handle of the tool to be held is inserted. Turning of wing nut (8) causes cable to tighten downward toward plate (2) securing the tool.

Figure 3:
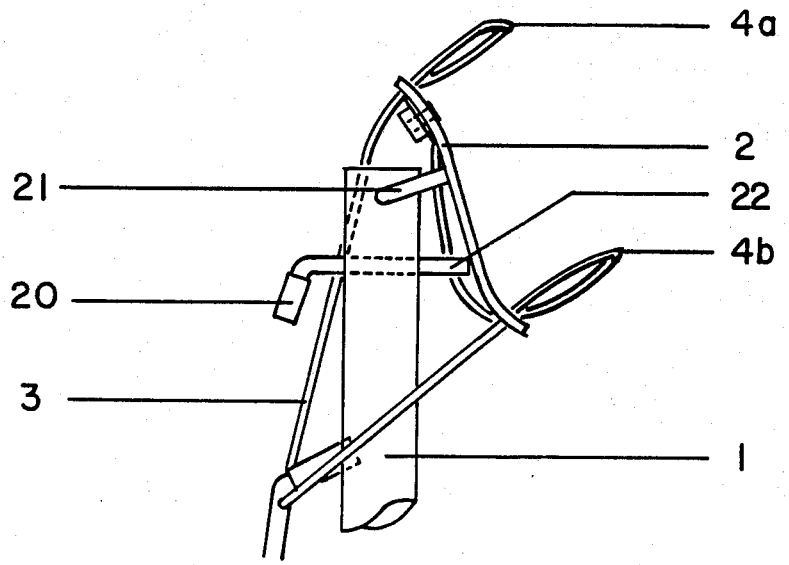
FIG. 3 is a fragmentary view of the support plate showing adjustment bar.

Referring to FIG. 3, there is shown the attachment of plate (2) to extension handle (1). This attachment is such that the angle of the support plate (2) can be adjusted thereby adjusting of the tool to the work surface. Connecting rod (21) provides a hinge-type connection. Rod (21) is U-shaped, extends through handle (1) such that it is movable, and fastens to the back of plate (2) on two sides. Adjustment rod (20) allows one the angle of plate (2). Rod (2) extends through handle (1) by screw type connection. Screwing rod (20) inward forces the bottom of plate (2) outward by rod tip (22) thereby allowing just the angle of the tool.

The tool holder may be a part of an extension handle suitable to reach high plate, i.e., from two to several feet long. In an alternate embodiment, it may be a part of a shorter handle which itself has a means of attachment to another extension pole. As an example, handle (1) could be be one foot long with tool holder connected to one end, and other end could have a threaded insert suitable for connecting to a second extension pole with threaded end. The second extension pole would be attached to first extension handle having the tool holder with the net effect of extending the length.

The tool holder is preferably made from a light weight metal such as aluminum. Other materials are possible including other metals an wood. When tool holder (1) is attached to a second extension handle, tool holder (1) may be made of aluminum, and the second extension handle made of wood.

The present invention may, of course, be carried out in other specific ways than those herein set forth without parting from the spirit and essential characteristics of the invention. The present embodiments are, therefore, to be considered in all respects are illustrative and not restrictive, and all changes within the meaning and equivalency range of the appended be intended to be embraced therein.

What is claimed is:

1. A tool holder for holding various tools on the end of an extension handle, comprising:

a. an extension handle;

b. a support plate connected to one end of said extension handle;

c. a support post extending from said extension handle, said post being attached at one end to said handle, and having hole at other end;

d. a guide bar being inserted through hole of said post, having at one end a threaded portion with suitable threaded nut and hole at other end;

e. a cable for holding tool firmly against said support plate, said cable being connected to one upper corner of said plate and thereafter passing through hole in other upper corner of said plate to form first loop, thereafter passing through hole in said guide bar, thereafter passing through hole in one lower corner of said plate extending upward and then downward through hole in other lower corner to form second loop, where f. the handle of tool to be held is inserted through said first loop and said second loop, and said cable is tightened down securing handle against said plate by turning said nut on said guide.

2. A tool holder as recited in claim 1, further comprising:

a. a hinge-type connection between said handle and said support plate including a U-shaped bolt connection where said bolt passes through hole in said handle and is connected at both ends to said support plate.

3. A tool holder as recited in claim 2, further comprising:

a. a means for adjusting angle of said plate relative to said handle.

4. A tool holder as recited in claim 1, further comprising:

a. a means of attachment of said first handle to a second extension handle extending the length of said first handle having the tool holder, means including a thread insert on said first handle and a suitable thread connector on said second handle.

5. A tool holder as recited in claim 1, wherein: said extension handle and said support plate are made of aluminum.

* * * * *